US008225443B2

(12) United States Patent
Stefano et al.

(10) Patent No.: US 8,225,443 B2
(45) Date of Patent: Jul. 24, 2012

(54) BEDPAN SYSTEM

(76) Inventors: Sandra Stefano, Bedford Hts., OH (US); Anthony G. Martin, Bedford Hts., OH (US)

( * ) Notice: Subject to any disclaimer, the term of this patent is extended or adjusted under 35 U.S.C. 154(b) by 99 days.

(21) Appl. No.: 12/626,879

(22) Filed: Nov. 27, 2009

(65) Prior Publication Data

US 2010/0125951 A1 May 27, 2010

Related U.S. Application Data

(60) Provisional application No. 61/117,977, filed on Nov. 26, 2008.

(51) Int. Cl.
*A47C 17/00* (2006.01)

(52) U.S. Cl. ..... 5/695; 5/604

(58) Field of Classification Search ..... 5/604, 605, 5/694, 695, 706, 710–713, 653, 654, 655.3, 5/606, 631, 730
See application file for complete search history.

(56) References Cited

U.S. PATENT DOCUMENTS 4,011,610 A * 3/1977 Parker, III ..... 5/604
4,472,848 A 9/1984 Newman
4,836,141 A * 6/1989 Whitfield ..... 119/169
5,081,721 A 1/1992 Stefano
5,522,103 A 6/1996 Kier et al.
6,000,078 A * 12/1999 Stefano ..... 5/695
6,223,368 B1 5/2001 Anslin
6,243,898 B1 6/2001 Ruff
6,523,198 B1 2/2003 Temple
6,725,485 B2 * 4/2004 Hayes ..... 5/695
7,048,703 B2 * 5/2006 Riach ..... 602/13
7,134,158 B2 11/2006 Tokarz
2006/0265810 A1 * 11/2006 Wu ..... 5/712
2007/0214575 A1 * 9/2007 Austen et al. ..... 5/706

* cited by examiner

*Primary Examiner* — Robert G Santos
*Assistant Examiner* — Nicholas Polito
(74) *Attorney, Agent, or Firm* — Dwight A. Stauffer

(57) ABSTRACT

A bedpan system including an underlayment for supporting a supine human patient above a substantially horizontal supporting surface, wherein the underlayment has: a substantially horizontal top surface upon which the patient rests, a substantially parallel, spaced apart bottom surface for lying upon the supporting surface, and a bedpan cavity having an open top in registry with buttocks of the patient; the bedpan system comprising: an underlayment that is an inflatable mattress constructed substantially of flexible plastic sheet material comprising: a top sheet providing the top surface, a bottom sheet providing the bottom surface, side wall sheets attached between the top sheet and the bottom sheet providing substantially vertical side walls around the perimeter of the underlayment when it is inflated, and cavity sidewall sheets attached between the top sheet and the bottom sheet providing substantially vertical sidewalls in the cavity; a cavity base that is joined to the cavity sidewalls as a closed bottom for the cavity, thereby effectively making the bottom surface of the underlayment a single, unitary, or continuous sheet including under the cavity; a smooth junction where the cavity sidewalls join with the top surface; and a smooth junction where the cavity sidewalls join with the cavity base.

12 Claims, 7 Drawing Sheets

BEDPAN SYSTEM

CROSS-REFERENCE TO RELATED APPLICATIONS

This application claims the benefit of U.S. Provisional Patent Application No. 61/117,977, filed Nov. 26, 2008 by Stefano et al.

The bedpan system of the present invention is particularly related to a patient underlayment device (mattress) similar to that of previous U.S. Pat. No. 4,949,409, PNEUMATIC PATIENT LIFT TO AID BEDPAN USE, to the method of previous U.S. Pat. No. 5,081,721, METHOD OF USING INFLATABLE PATIENT SUPPORT WITH A BEDPAN, and to the DISPOSABLE BEDPAN SYSTEM FOR USE WITH ELEVATED PATIENT SUPPORT of U.S. Pat. No. 6,000,078; all issued to the present inventor, Sandra Stefano. Therefore, the disclosures of U.S. Pat. Nos. 4,949,409 and 5,081,721 and 6,000,078 are incorporated in their entirety herein by reference.

TECHNICAL FIELD OF THE INVENTION

The present invention relates to a bedpan system comprising a combination of an elevated patient support and a flexible bedpan for deployment in a cavity of the patient support.

BACKGROUND OF THE INVENTION

The present invention is particularly for use by people who are confined to bed for medical or other reasons, and most particularly for such people as are significantly immobile, and/or incontinent. The present disclosure concerns improvements to bedpan system apparatus and methods such as those previously disclosed by the present inventor, Sandra Stefano.

Anyone who has been confined to bed and has faced using a bedpan for defecation or urination while so confined, appreciates the embarrassment and discomfort associated with the use of a bedpan while bedridden. The discomfort is especially critical for patients whose condition requires them to remain nearly horizontal, not allowing the patient to be raised to approach a sitting position. In such situations, the elevation of the hips caused by a bedpan inserted between the patient and a flat supporting surface puts the patient into a position in which most find defecation nearly impossible. Little need be said of the personal discomfort that arises from sustained periods during which defecation is denied, not to mention the physiologic difficulties that may result, such as diverticulitis or impaction.

Prior art, especially that of the present inventor listed above, has provided an underlayment, which could be a mattress, for placing beneath a bedridden patient to elevate the patient above any underlying substantially horizontal support and, by means of a cavity in the underlayment, clearance is provided for the placement of a bedpan for use by the patient.

There is a particular need for bedpan systems that accommodate the special needs of patients who are bedridden for long periods of time, and/or are substantially immobile, and/or have especially sensitive or fragile skin (e.g., burn patients, elderly). In such cases the bedpan system must allow insertion and removal of the bedpan without requiring significant movement of the patient's hips or thighs, and without scraping, rubbing hard, or otherwise irritating or deleteriously affecting a patient's sensitive skin.

Another concern that is particularly heightened for such special needs bed patients is the surface of the underlayment. The underlayment must not present any rough or hard edges under the patient, and consequently any covering (e.g., a sheet) must also be as smooth and wrinkle-free as possible. Furthermore, while the underlayment must allow for cleaning and disinfecting, it should not be slippery. Preferably the material will also allow some "breathing" rather than causing the patient to sweat where in contact with the underlayment.

Finally, as a practical matter, it is desirable to provide sufficient space between the bedpan and the patient such that a caregiver can clean the patient without access being impeded by the bedpan, and without danger of the caregiver's hand being in contact with the contents of the used bedpan.

It is known from the inventor's previous patents to provide an inflatable mattress having a cavity below (in registry with) the buttocks of a supine patient lying on the mattress. This cavity accommodates a bedpan of common commercial use so that, owing to the low inflation pressure of the inflatable mattress, the surface of the mattress may easily be depressed, thereby to permit such bedpan of common commercial use to be inserted into—and subsequently removed from—the cavity without deleterious contact with the patient's skin, even if the patient's legs cannot be moved or raised.

It is also known to provide disposable bedpans that are flexible enough to be used in conjunction with a variety of patient underlayments with cavities including ones that are far more rigid than an inflatable mattress. These known disposable bedpans comprise bags formed of flexible plastic sheeting plus some means of holding the bag open for use as a bedpan. After use, if the bag can be collapsed it is then pulled out between the patient's legs (and/or under the legs if the mattress is flexible enough to depress).

U.S. Pat. No. 6,725,485 (Hayes; 2004) discloses a bedpan system embodiment using a wastebag (50) as the human waste receptacle. In this embodiment, a support ring (53-55) mates with the cavity (17) under spring tension. One portion of the support ring (54) is supported on the top surface of the mattress, another portion (55) extends into the cavity, and a third portion (53) completes the support ring (53-55). The wastebag is secured to the ring by means of an elastic material (51). To facilitate the placement and removal of the support ring (53-55) into the cavity, a handle (56) extends from the support ring and acts like a spring so as to be under tension when the end of the handle (52) engages the cavity (17). Hayes also discloses various means for filling the cavity when not housing a bedpan: a controllable expandable (inflatable) cushion (16), or a full size cavity plug (17', FIG. 10). Disclosed bed coverings include a bed sheet (30) with a slit over the cavity that is closed by a flap or fly (31, FIG. 7-8), or a conventional bed sheet (30) and underpad (33) that are gathered into the cavity (FIG. 15-16).

Apparent limitations: Hayes' support ring portion (54) that rests on the top surface of the mattress could be irritating if left in place, and the support ring (53-55 as seen in Hayes' FIG. 17) appears to be a formed wire, multilevel metal structure that may be difficult to move past the patient's legs if they can't be lifted. Hayes' full size cavity plug would be very difficult to remove when a patient is present. As can be seen in Hayes' FIGS. 7, 8, 15, and 16, his bed coverings all present potentially irritating wrinkles or ridges that would be under a supine patient. Furthermore, the edges of a slit would have to be dragged under an immobile patient's buttocks in order to spread it open to reveal the cavity.

U.S. Pat. No. 4,011,610 (Parker, III; 1977) discloses a bedpan system in which a mattress has an opening to accept a bedpan assembly (42, 44), the bedpan (42) being provided with a disposable liner/bag (46) to fully cover the surfaces engaged during usage (bedpan seat 44) and with the mouth of the liner being trapped between the bedpan (42) and the mattress, with a sheet having a central aperture and a cuff (40) to line and protect the aperture in the mattress, the cuff (40) being trapped between the mattress and the bedpan (42), with a mattress plug (26) to resiliently cover the bedpan (40) when not in use and provide a rigid supporting base (70) to center the plug, and an anti-contamination supporting plate (80) underlying the mattress and the bedpan (40), and serving to control the position of the bedpan (400) relative to the springs and mattress. A covering sheet (48) may be tied or otherwise secured upon the mattress plug.

It is apparent that while Parker's disposable bag can be removed without significantly disturbing the patient, the same cannot be said for the bedpan that therefore is intended to be left in place as a support for the mattress plug. Apparent limitations include a complex mattress design including difficult to clean recesses, a bedpan that may need to be removed in order to clean it if needed, and a cavity that isn't fully enclosed—therefore being difficult to de-contaminate in the event of spills. The plug appears to be rather bulky and therefore difficult to insert/remove under a patient. Finally, it is not apparent how a new disposable bag can be easily deployed on the bedpan when an immobile patient is lying over it.

U.S. Pat. No. 6,000,078 (Stefano; 1999) discloses a disposable bedpan system for use with a patient underlayment (40) that has a cavity (42) in registry with the buttocks of a supine patient lying thereon. The disposable bedpan (20) is supported in said cavity by a laterally-collapsible hoop-like support (30). In the best mode, the hoop-like support has fulcrum extensions (36) to provide support for the underlayment. Markings (26) on the disposable bedpan (20) provide a tool to measure the volume of waste from the patient. A padded plug (70) that fills the space between the hoop-like support and the top of the underlayment provides comfort for the patient while the bedpan (20) is installed but not in use.

U.S. Pat. No. 6,243,898 (Ruff; 2001) discloses a mattress having a centrally located cut-out portion that has an insert (50) that fits therein. The combination of the mattress and insert provides a flat surface on which a bedridden person can lie. The insert is removable from the cut-out portion so that a bed pan may be placed therein. A first fitted sheet (70) surrounds the mattress and extends within the cut-out portion, while a second fitted sheet (80) surrounds the insert. In combination, the first and second fitted sheets provide a sanitary covering to the mattress and insert that can easily be replaced, but one that will not come loose merely from the movement of the person on the mattress. The first fitted sheet is secured about the bottom of the mattress by means including elastic bands (72) as on conventional fitted sheets, especially those for a water bed mattress. The first fitted sheet may either extend within cut-out portion (40) and completely cover the inner surfaces of the cut-out portion, including the sides (44) and floor (46), as shown in Ruff's FIG. 2, or first fitted sheet may be designed to extend down the inner sides of cut-out portion, as shown in Ruff's FIG. 1. In either case, the first fitted sheet performs its function to cover those areas of mattress (20) that would be in contact with a person lying on the bed. Furthermore, by extending the first fitted sheet within the cut-out portion the first fitted sheet is thereby secured about the perimeter of the cut-out portion, so that the mattress will not readily be uncovered. The second fitted sheet (80) surrounds insert (50) by grabbing its bottom edges (56) with preferably an elastic band (82), much the same way as the first fitted sheet is secured about the mattress.

Although Ruff's first fitted sheet may be held wrinkle free, it appears that the second fitted sheet is not well enough secured by its elastic bands, and furthermore does not provide a convenient way to grasp and pull out the insert when a patient is lying thereupon.

The foregoing illustrates limitations known to exist in prior art devices and methods. Thus, it is apparent that it would be advantageous to provide an alternative directed to overcoming one or more of the limitations set forth above. Accordingly, a suitable alternative is provided including features more fully disclosed hereinafter.

BRIEF SUMMARY OF THE INVENTION

A full size underlayment (mattress) to be placed onto any hospital bed and/or commercial bed as the only underlayment, or on top of a regular bed mattress. This underlayment can also be made to fit any hospital gurney for post operating rooms, emergency rooms or recovery rooms. The underlayment can be made with a smooth flat surface, but preferably has a cushioning tufted surface for safety and comfort. This underlayment is portable and can be removed and replaced anywhere. The underlayment is an inflated mattress customized with a cavity to accommodate the insertion of a bedpan or bedpan bag or other human waste receptacle. This enables patients to use the waste receptacle while in a supine or seated position on the underlayment.

The underlayment's entire top and bottom surface is made with a flocked surface to prevent perspiration and sliding. A full outer side wall surrounds the entire underlayment connecting the top and bottom surface for stability. The bottom surface is one piece and solidly closed-in under the cavity.

The cavity is located for registry with the patient's buttocks area. The cavity could be of any shape to accept any type of human waste receptacle (bedpan), but in a preferred embodiment the cavity is wedge-shaped for safety and sanitation purposes, being laterally narrowed at its head of the bed end for better support of the patient's buttocks.

This cavity is fully opened at the top surface and has an inner side-wall which surrounds the entire inside of the cavity and goes straight down into the entire depth of the cavity, but, does not go all the way through, instead being joined to the bottom surface of the underlayment, which forms the cavity's base. Thus the open topped cavity is otherwise enclosed by a single connected surface. This inner side-wall and inner base of cavity is also made with the same material as the underlayment's outer side-wall, which can be washed and disinfected as well as the entire underlayment. This underlayment is equipped with one and/or two 2-way check valves to receive and release air supplied by, for example, an air compressor.

The waste receptacle is preferably a disposable bedpan assembly including a disposable, flexible bedpan bag with a drawstring closure at its top opening, and a flexible support ring preferably having two integral fulcrum extensions extending therefrom for tilting the support ring into position when inserting into the cavity, and as vertical supports for the bedpan bag.

The underlayment design enables a receptacle to be inserted and removed from the cavity from in between the patient's legs or inner thighs. The receptacle may remain inside the cavity with or without a covering cushion (plug). This cushion can rest on top ridge of receptacle, under patient's buttocks to form a full solid underlayment, and is inserted and removed from in between the patient's inner thighs.

The cushion is made of foam material with a soft top surface which is attached to a flexible plastic base for easy insertion and removal, while supplying stability as it rests on the top of receptacle's surface. If so desired, a full foam cushion can also be used to fill in entire cavity without the receptacle.

A custom made pocket sheet or any commercial sheet will cover the underlayment, with the pocket or excess sheet being tucked into the cavity. Then a flexible plastic shield, also wedge-shaped, with an opening at its wide end for finger gripping during insertion and removal, also has ½" extensions upward on each side to secure the receptacle's fulcrum extensions, is placed into the cavity bottom, to prevent and/or remove any sheet's wrinkles around the top edge surface of the cavity.

In an embodiment of a method of use, the underlayment is placed onto a bed base, springs, board, or a regular mattress, and inflated with any type of air compressor through the underlayment's two-way check valve, to the capacity texture of doctor's prescription, or just patient's weight and comfort. Then the sheet is placed over the entire underlayment, with pocket placed into cavity. Then the shield is placed into cavity's base. Then the disposable bedpan assembly (receptacle) is placed inside cavity and rests securely on top of shield. Then, depending on patient's need or requirements the cushion is placed in cavity and rests on top edge of receptacle. The plug cushion is covered with a custom made pillow case, with an elongated end for removal, and rests securely under patient's buttocks.

Now the patient is placed, e.g. in a supine position, onto the underlayment which is then used as his or her main underlayment.

For use of the bedpan, the cushion is pulled out from in between the patient's inner thighs, by Dipping the cushion case's elongated end, and pulling straight out underneath the patient, with no moving or touching the patient. Now the uncovered receptacle is ready for use as it is directly under the patient's buttocks. When elimination function is complete, the used receptacle is removed out of the cavity from in between patient's inner thighs, by pulling the receptacle's finger tab out in an upward angle. The elongated flexible receptacle allows the contaminated substance to flow down into the elongated end, again without moving or touching patient.

Now the attendant has six inches under the patient's buttock to clean them up. Again without moving patient. Then a new flexible receptacle is replaced by squeezing it shut and sliding it down into cavity, without touching or moving patient. As receptacle meets with the narrow inner side-wall of cavity its base, the receptacle pops open and fits securely and snuggly in place, under patient's buttocks and ready for next usage.

If plug cushion needs to be replaced, the surface of underlayment is simply pressed down and plug is slid in under patient's buttocks from between/under patient's inner thighs.

Other objects, features and advantages of the invention will become apparent in light of the following description thereof.

BRIEF DESCRIPTION OF THE DRAWINGS

Reference will be made in detail to preferred embodiments of the invention, examples of which are illustrated in the accompanying drawing figures. The figures are intended to be illustrative, not limiting. Although the invention is generally described in the context of these preferred embodiments, it should be understood that it is not intended to limit the spirit and scope of the invention to these particular embodiments.

Certain elements in selected ones of the drawings may be illustrated not-to-scale, for illustrative clarity. The cross-sectional views, if any, presented herein may be in the form of "slices", or "near-sighted" cross-sectional views, omitting certain background lines which would otherwise be visible in a true cross-sectional view, for illustrative clarity.

Elements of the figures can be numbered such that similar (including identical) elements may be referred to with similar numbers in a single drawing. For example, each of a plurality of elements collectively referred to as 199 may be referred to individually as 199*a*, 199*b*,199*c*,etc. Or, related but modified elements may have the same number but are distinguished by primes. For example, 109, 109', and 109" are three different elements which are similar or related in some way, but have significant modifications. Such relationships, if any, between similar elements in the same or different figures will become apparent throughout the specification, including, if applicable, in the claims and abstract.

Figure 1:
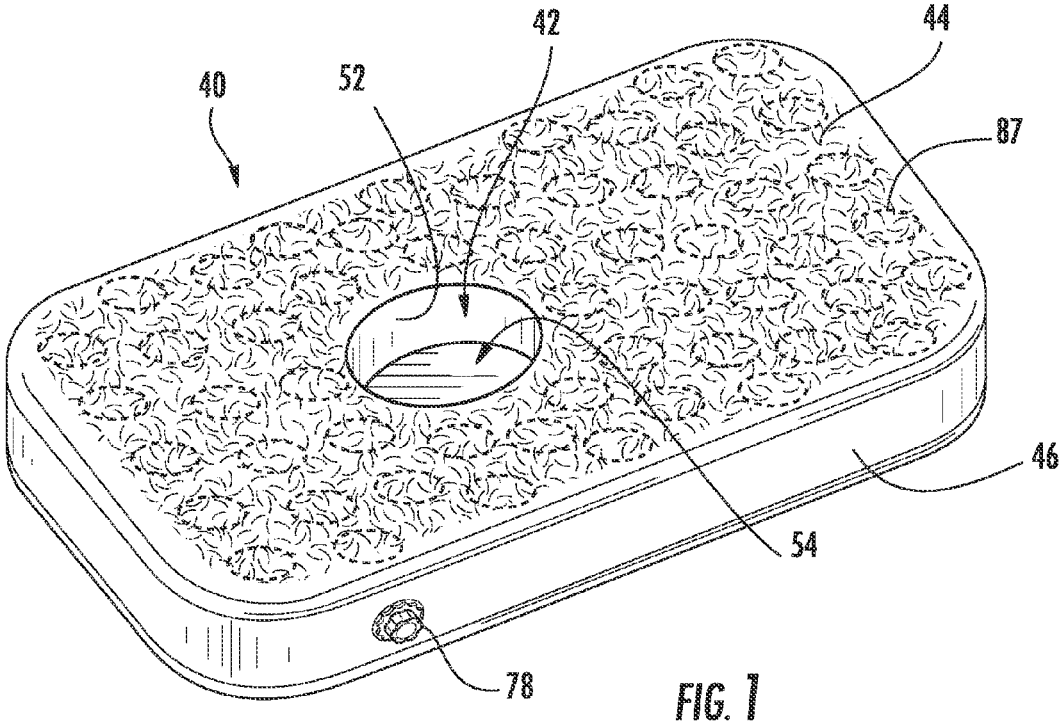

The structure, operation, and advantages of the present preferred embodiment of the invention will become further apparent upon consideration of the following description taken in conjunction with the accompanying drawings, wherein:

FIG. 1 is a perspective view of an underlayment with a closed bottom cavity according to the present invention.

Figure 2A:
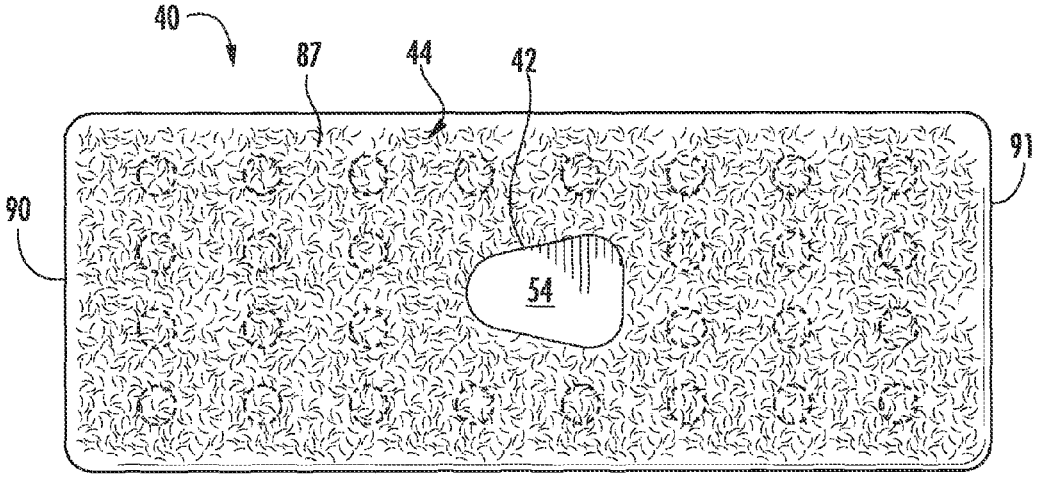

FIG. 2A is a top view of a preferred embodiment of an underlayment with a cavity that is narrowed at one end according to the present invention.

Figure 2B:
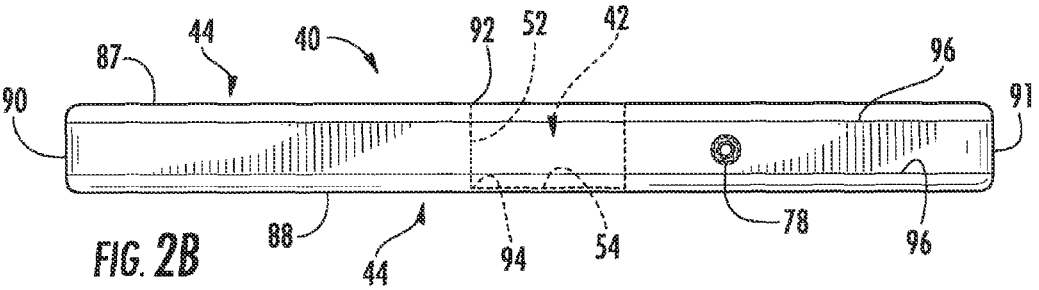

FIG. 2B is a side view of the underlayment of FIG. 2A according to the present invention.

Figure 2C:
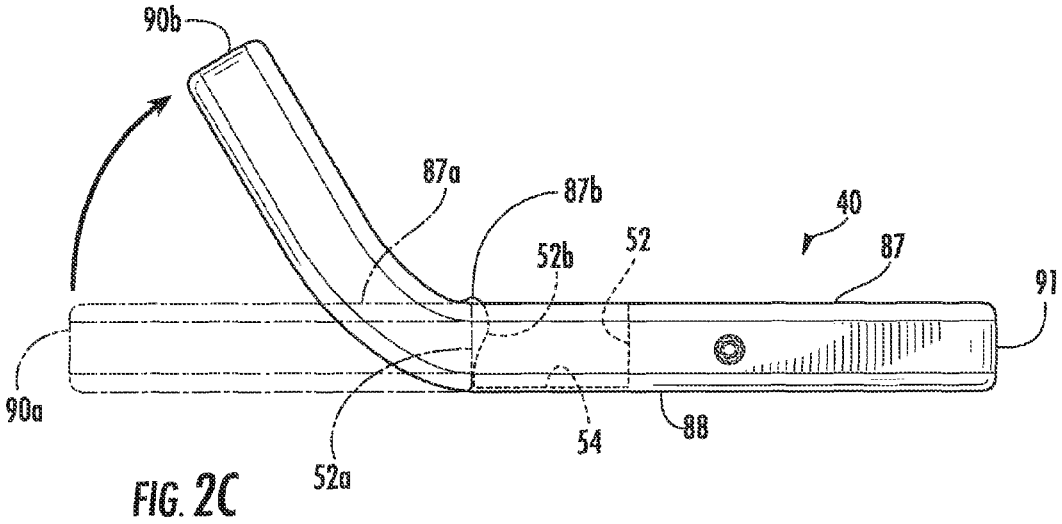

FIG. 2C is a side view of the underlayment of FIG. 2A, shown in a normal flat condition compared to a bent condition such as can result from raising a head portion of a hospital bed support, according to the present invention.

Figure 3:
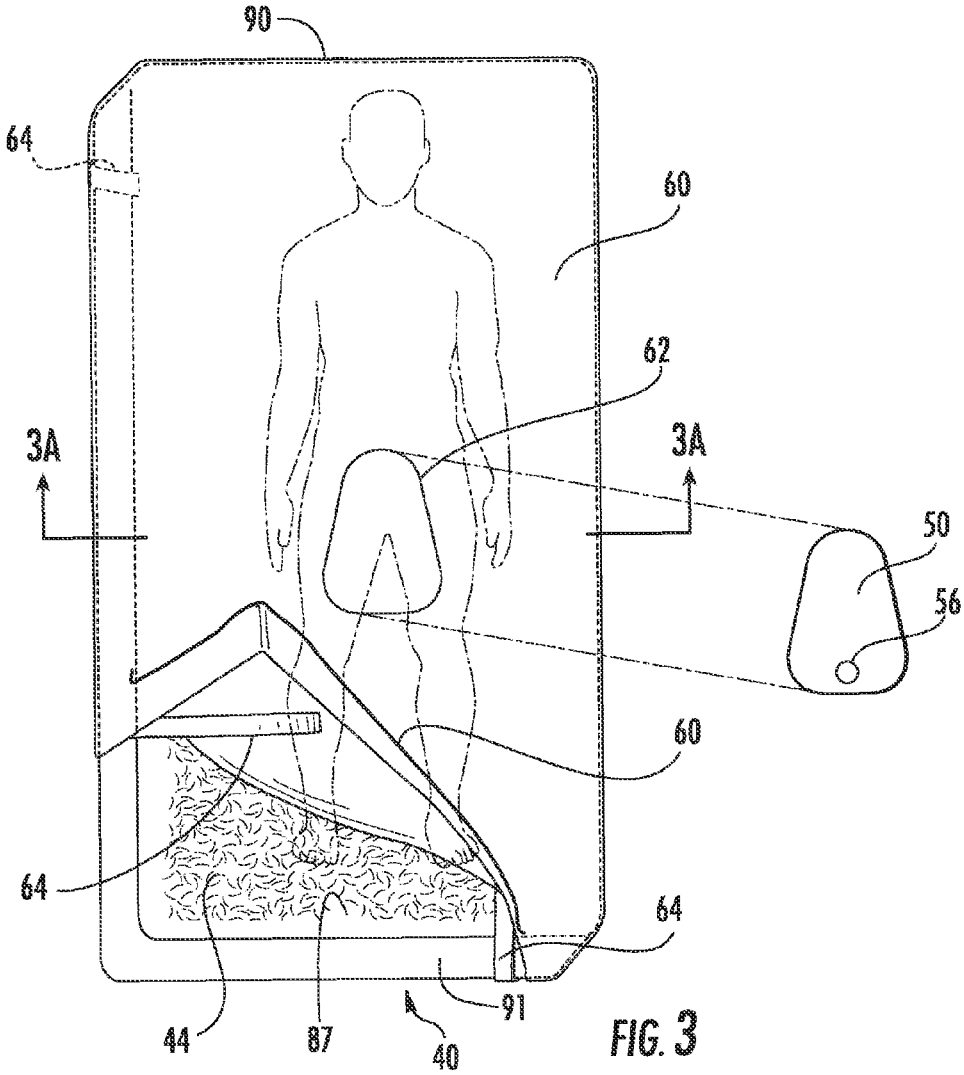

FIG. 3 is a perspective view looking down at a bed sheet customized with a pocket shown on the underlayment of FIG. 2A, according to the present invention.

Figure 3A:
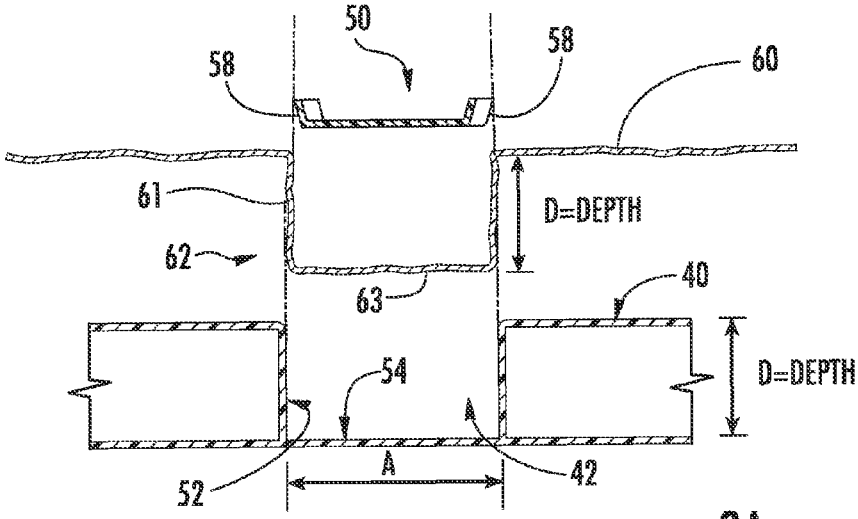

FIG. 3A is a side cross-sectional view taken along the line 3A-3A in FIG. 3, but exploded vertically to show the relative dimensions and positions of a shield in the bed sheet pocket in the underlayment cavity, according to the present invention.

Figure 4:
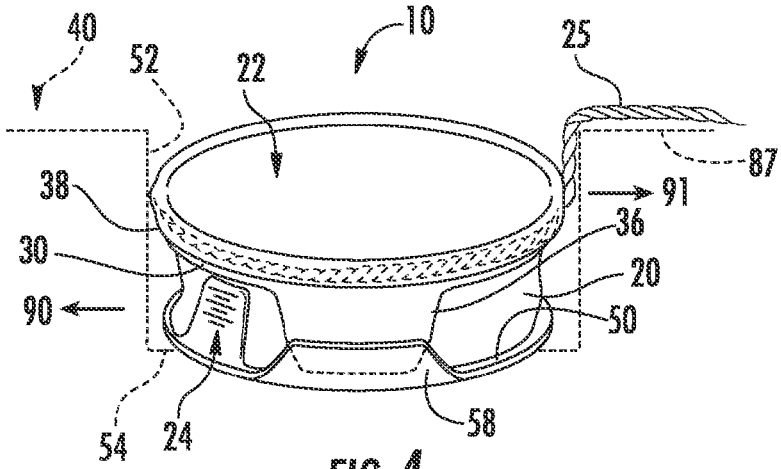

FIG. 4 is a perspective view of a preferred embodiment of a bedpan assembly according to the present invention.

Figure 4A:
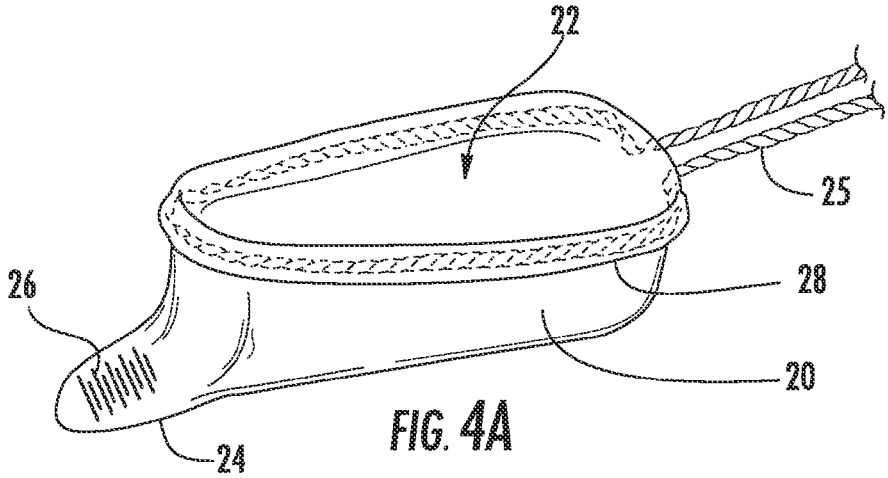

FIG. 4A is a perspective view of a disposable bedpan bag portion of the bedpan assembly of FIG. 4, according to the present invention.

Figure 4B:
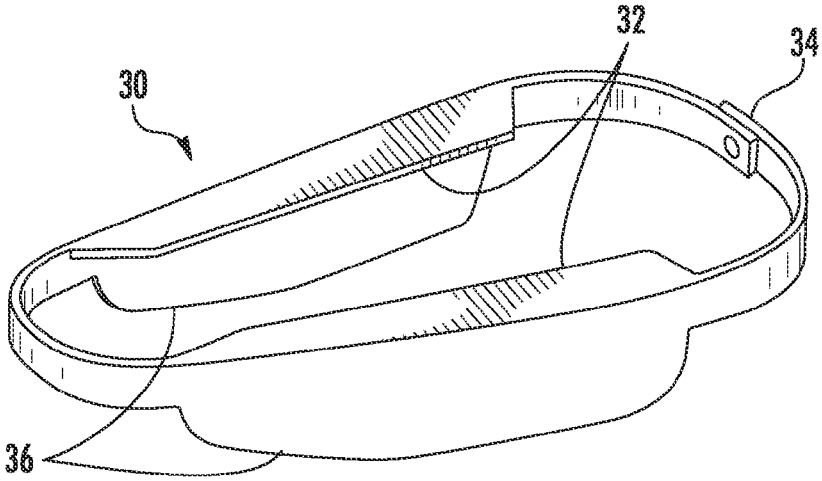

FIG. 4B is a perspective view of a support ring portion of the bedpan assembly of FIG. 4, according to the present invention.

Figure 5:
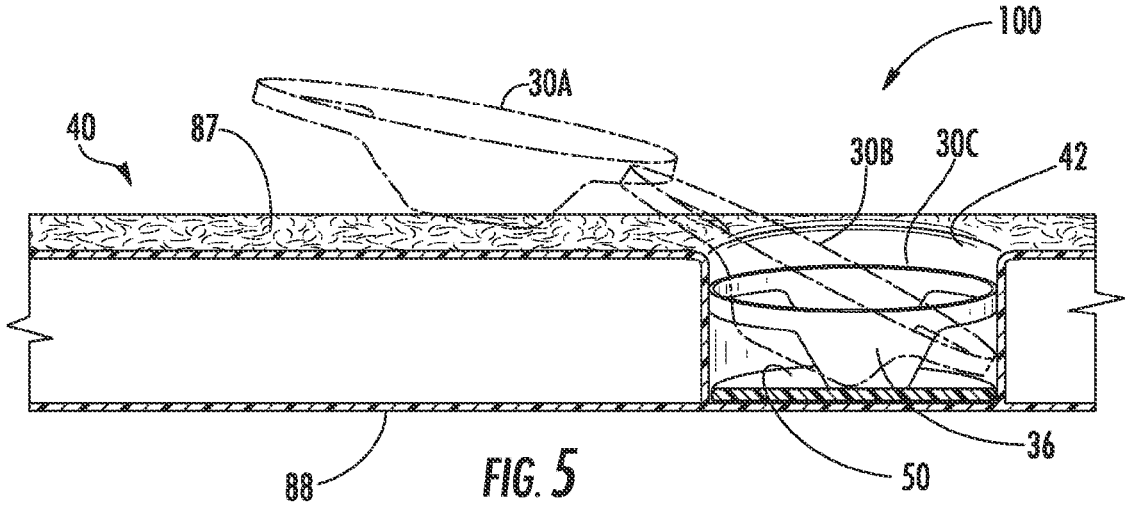

FIG. 5 is a partial cross-section of the underlayment of FIG. 1 showing a method of inserting of a bedpan support ring into the cavity, according to the present invention.

Figure 6:
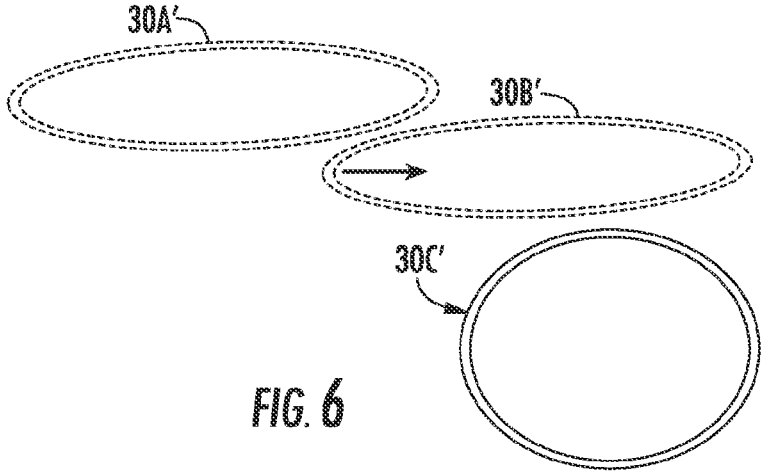

FIG. 6 is a top view of the support ring during the inserting method shown in FIG. 5 according to the present invention.

Figure 7:
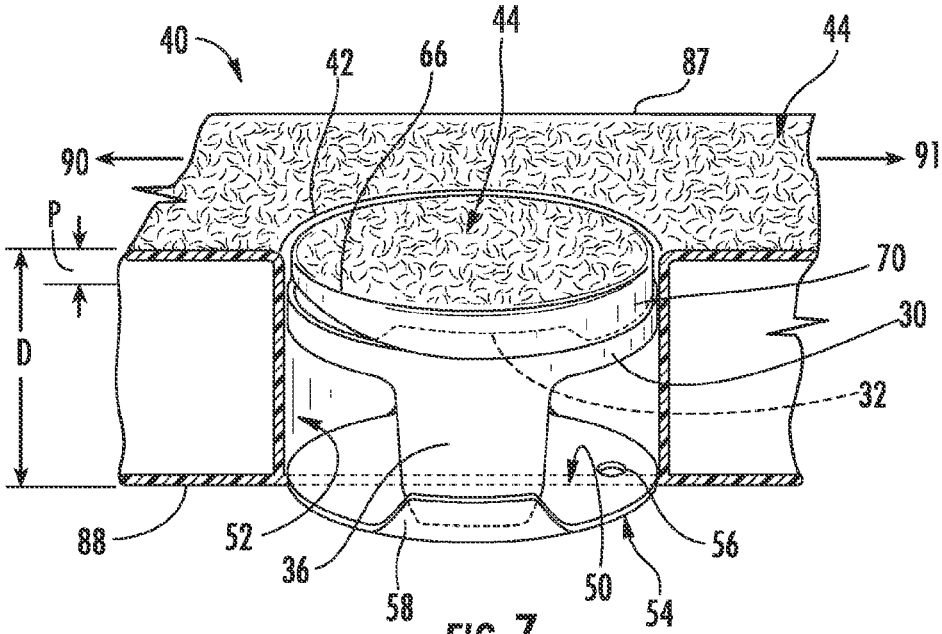

FIG. 7 is a perspective view of a support plug resting on top of the support ring which sits on the shield in the cavity of the underlayment (shown in cross-section), according to the present invention.

Figure 8:
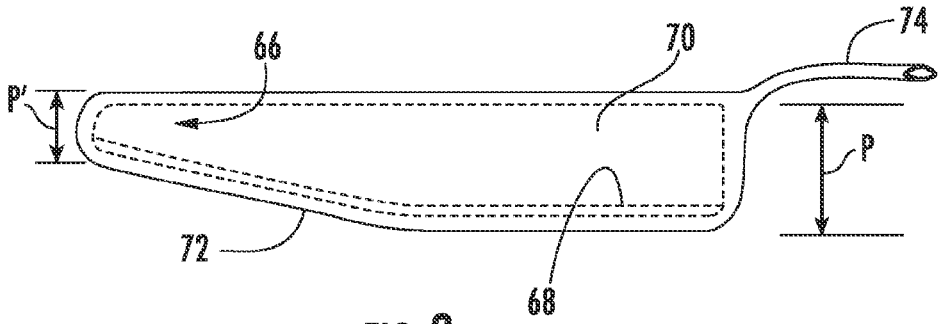

FIG. 8 is a side view of the support plug inside of a pillowcase according to the present invention.

Figure 9A:
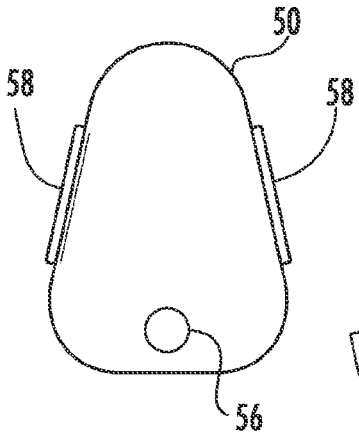
Figure 9B:
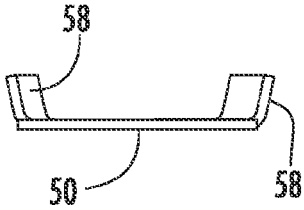

FIGS. 9A and 9B are top and side views, respectively, of a shield according to the present invention.

Figure 9C:
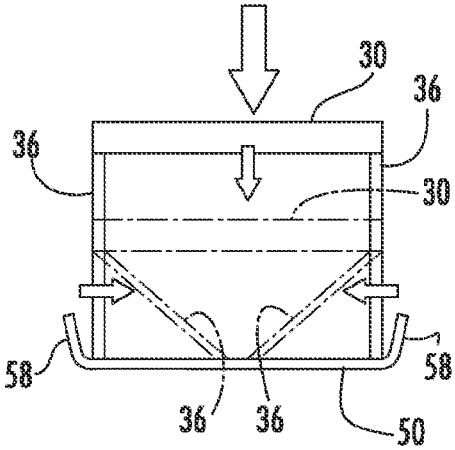

FIG. 9C is a side schematic view of a support ring with fulcrum extensions shown relative to the shield of FIGS. 9A and 9B, solid lines indicating a normal in-use position and dashed lines indicating a partially collapsed position resulting from downward pressure on the support ring, according to the present invention.

Figure 10A:
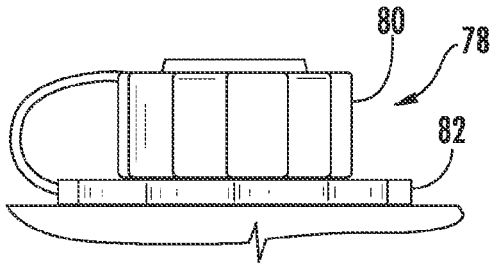
Figure 10B:
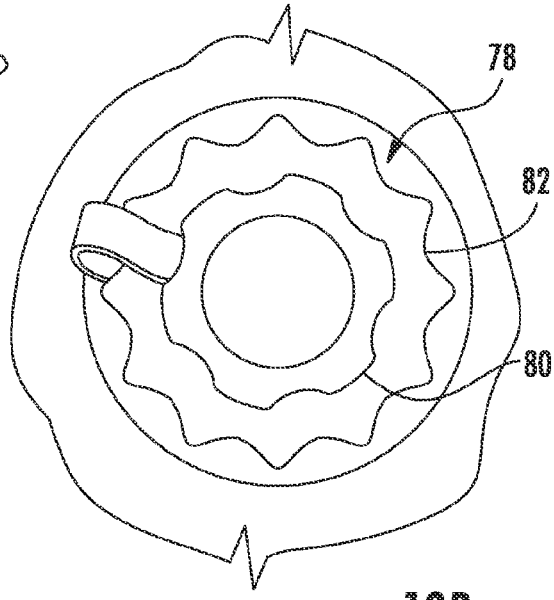

FIGS. 10A and 10B are top and side views, respectively, of a 2-way check valve according to the present invention.

Figure 11:
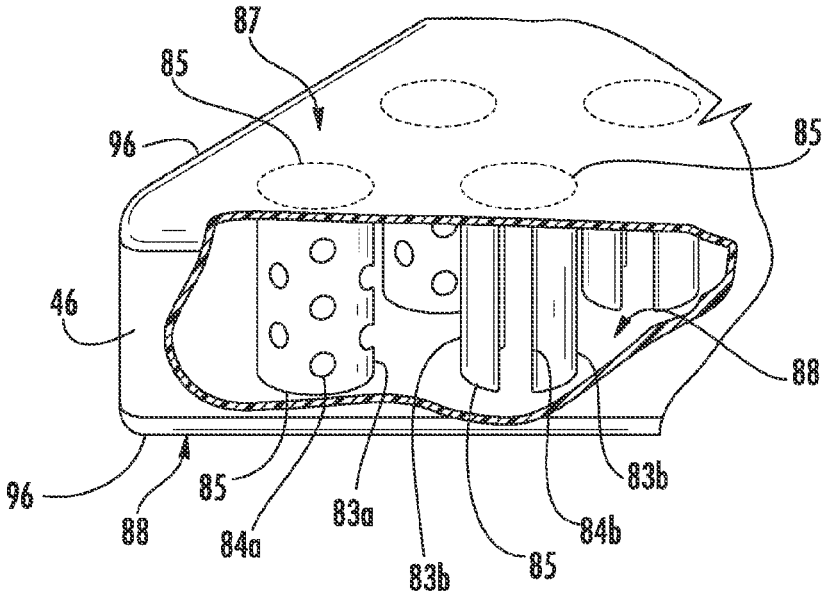

FIG. 11 is a perspective end view of an underlayment showing, through a cutout portion, its interior with two embodiments of stabilizing elements, according to the present invention.

DETAILED DESCRIPTION OF THE INVENTION

The present disclosure concerns one or more inventions providing a bedpan system specially adapted for use by bedridden patients, especially those patients who cannot be moved from a supine position. In general, a bedpan system 100 according to the present invention comprises the following "component" groupings of elements, sub-elements, features, aspects, and characteristics, both separately and in various combinations:

a. An underlayment 40 comprising: a mattress, preferably an inflatable mattress constructed substantially of flexible plastic sheet material, and having one or more flocked surfaces 44.

b. A mattress cavity 42 open at its top, having a substantially vertical inner side-wall 52, a closed bottom (base) 54, and smooth junctions at seams 92, 94 of the plastic sheet material. Preferably the cavity shape A, in top view, is narrowed toward a head 90 of the underlayment 40.

c. A bed sheet 60 having a pocket 62 that is positioned and sized to closely fit within the cavity 42 when the bed sheet 60 is installed on the underlayment 40. Preferably elastic corner straps 64 hold the bed sheet 60 in place when installed.

d. A disposable bedpan assembly 10, comprising a disposable, flexible bedpan bag 20 with a drawstring 25 closure at its top opening, and a flexible support ring 30 preferably having two integral fulcrum extensions 36 (fulcrums) extending therefrom for tilting the support ring 30 and as vertical supports.

e. A rigid shield 50 shaped to closely fit in the cavity 42 and cover the cavity base 54. The shield has side ridges 58 for controlling the position of the fulcrum extensions 36 of the bedpan assembly 10.

f. An optional support plug 70, preferably a foam cushion, for placement atop the support ring 30 of the flexible bedpan assembly 10 when it is installed and not in use. Preferably the plug 70 has a flocked surface 44 on top and a rigid bottom surface 68 plus a vertically tapered end 66 for easing insertion and removal. A pillowcase 72 may be provided with a long tail 74 for pulling on the support plug 70.

All components of this invention are portable, being easily collapsed and compacted for storage or moving. They are also relatively inexpensive such that the entire system 100 and/or any of its components, including the underlayment 40, may be considered disposable and/or suitable to send home with a patient after their use in a patient care center.

In general, where the term "plastic" is used herein, it should be interpreted broadly to include within its scope any material suitable for its function as disclosed (rigid, flexible, cleanable, etc.), such material being selected according to conventional design standards. For example, the "plastic" underlayment material could even be rubberized fabric to meet the flexibility and inflatability functional requirements, but it is probably not preferred since the fabric would be difficult to sanitize suitably. In general, the "plastic" components of the invention are preferably made of a thermoplastic material (e.g., vinyl), and can be thoroughly washed and sterilized, per AMA regulations.

The components/elements listed above, and their relationships to the inventive bedpan system 100 will be described below in detail, given in context.

Underlayment

FIG. 1 shows an underlayment 40 of the type used in this invention. The underlayment 40 comprises a mattress that may be of conventional construction, but is preferably of inflatable construction, said mattress having a cavity 42 open at the top surface thereof and deposed substantially in registry with the buttocks of a supine human patient lying on the underlayment 40 (also see FIG. 3). A full outer sidewall 46 surrounds the entire underlayment 40, extending substantially vertically between a top surface 87 and a bottom surface 88 for edge stability and is made with a plastic material. The top surface 87 and optionally also the bottom surface 88 of the underlayment 40 is "flocked" to create a permanent covering soft flocking material 44 to prevent perspiration and sliding. (A flocked surface, e.g. having the feel of suede, can be formed on a plastic sheet by means of known manufacturing process surface treatments.)

The underlayment 40 can fit any standard size hospital bed, and can also be made to fit any mattress gurney, emergency room bed, and post operation (recovery room) bed. The underlayment 40 can be used by bedridden patients in a supine, reclined, or seated position. The underlayment 40, left inflated, can be used in place of a regular mattress, or in situations where raising and lowering a patient is desired, the patient can be placed on a deflated underlayment 40 then raised by inflating the underlayment 40 while the patient lies on it. The inflatable underlayment 40 is preferably equipped with a two-way check valve 78 to receive and release inflation air, e.g., from an air compressor. FIGS. 10A and 10B illustrate an exemplary two-way check valve 78 such may be found on existing inflatables, wherein a cap 80 covers a check valve inlet that allows air blown in, but not out; and a screw base 82 can be unscrewed to allow air release below/behind the check valve. It is assumed that the valve 78 would be selected or adapted to meet requirements for filling from sources available in the patient care facility, and for releasing air in a controlled fashion, preferably variable from slow to rapid.

FIG. 11 illustrates further comfort and safety features wherein the top sheet 87 and bottom sheet 88 are joined at intervals over their areas, creating what might best be described as a tufted bladder construction, which joinings are made by means of intermediary strips 83 attached at each respective end 85 thereof to the top sheet 87 and bottom sheet 88, thereby the length of the strips 83 restricts the thickness attained by the underlayment 40. A best mode construction results when these strips are formed into split cylinders 83*b* whose circular ends 85 are attached to the top and bottom sheets, as shown in the drawings. An alternative construction, also providing a good mode, results when these strips are formed into perforated cylinders 83*a*. The safety aspect of the present invention comprises the cylinder openings 84 (e.g. a slit 84*b* or a hole 84*a*) that are shaped and sized to control the rate of air passage out of the strip/cylinders 83. This provides a safety backup limitation on the rate of deflation of a mattress/underlayment 40 independent of any size hole or tear or excessive opening of the deflation control 78. The art pertaining to the construction and use of inflatable mattresses and the like should be consulted for details of construction and variations thereof, including valving and inflating means 78 and inflating equipment.

There is no jarring of the patient while inflating/deflating the underlayment 40. If a puncture occurs in the underlayment 40 while a patient is on it, the patient will decline slowly and evenly, held in the center by the surrounding underlayment 40 which deflates more slowly than the mattress portion under the patient, and further supported by the internal cylinders 83 that limit the deflation rate even in the event of a catastrophic mattress failure, thereby satisfying AMA safety codes.

Cavity

Still in FIG. 1, the cavity 42 within the underlayment 40 is fully open at the top surface and has substantially vertical inner side-walls 52 that surround the entire inside of the cavity 42 down into the full depth of the cavity 42, joined at the bottom to a cavity base 54 (floor), thus forming a tightly connected leak proof surface that encloses the cavity 42. Since the inner sidewall 52 is substantially vertical, the opening at top is substantially a right-angled joining of the sidewall and the underlayment top surface. This enhances stability at the edge of the cavity 42, helping to keep a patient from sinking or sliding down into the cavity 42 (compare with prior art rounded openings where the top underlayment surface curves down to meet the bottom surface in a joint in the middle of the cavity depth). The inner sidewall 52 and base 54 of the cavity 42 are made with the same plastic material as the underlayment's outer peripheral side-wall 46, and can be washed and disinfected. They are not flocked, making them particularly easy to clean. As viewed from above in FIG. 2A, the cavity 42 is narrower toward the head 90 of the bed 40, under the lower tail bone and buttocks of the patient (see FIG. 3), to secure the patient and prevent the patient from slipping or sinking into the cavity 42. The other end of the cavity 42, towards the foot 91 of the underlayment 40, has a wider opening under the patient's upper thighs, thereby providing more room for a caregiver's hand to cleanse the patient and to work with a bedpan (e.g. the inventive bedpan assembly 10). The cavity 42 is laterally centered.

Referring now to FIGS. 2A-2C, the top surface (sheet of material) 87 is joined to the cavity sidewall 52 with a smooth surfaced seam 92, so that there are no rough edges under the patient or where a caregiver's arms pass by. This kind of seam is also better for sanitizing. For similar reasons, the top surface/sheet 87 is joined to the outer sidewall 46 with a smooth surfaced seam 96. The cavity sidewall 52 is similarly joined to the cavity base 54 with a smooth surfaced seam 94, for best sanitizing conditions. Although a separate sheet of material could be used for the cavity base 54 for extra strength, it is contemplated that a simple mode would be to use the bottom surface 88 sheet of material for the base 54 by simply joining the cavity wall 52 to the bottom sheet 88, thereby effectively making the bottom surface 88 of the underlayment 40 a single, unitary, or continuous sheet including under the cavity 42.

However it is done, it is important that the cavity 42 be closed at the bottom, not only for containing potential spills, but also for enhancing patient support, as will now be explained. FIG. 2C shows what happens when the head of a hospital bed supporting the underlayment 40 is raised to make it easier for a patient to use a bedpan in the cavity 42. The bed bends the underlayment 40 while raising the head 90 of it from the position indicated by reference 90*a* to 90*b*. Because the cavity bottom 54 bridges the cavity 42, it prevents the mattress around the cavity from expanding downward, and also works with the rest of the bottom surface 88 to prevent stretching. This forces the top portion of the mattress to be compressed in response to the bending action. Since the top of cavity 42 is open, the top surface 87 can push upward from 87*a* to 87*b* while the cavity wall 52 bulges inward and upward from 52*a* to 52*b*. Although illustrated with exaggerated displacements, it should be apparent that the effect of bending the underlayment 40 as shown is to increase localized pressure and support of a patient's buttocks.

Bed Sheet

Referring to FIGS. 3 and 3A, a custom fitted bed sheet 60 (e.g. made of soft material like 50% cotton and 50% percale) is tailored to cover the top surface 87 and side walls 46 of the underlayment 40, and has an integral pocket 62 tailored to closely fit as a lining inside the cavity 42, and to have a seam of the cavity pocket 62 with the top surface of the sheet 60 that is substantially smooth on top of the underlayment 40. The pocket 62 is positioned such that it is aligned with the cavity 42 when the sheet 60 is properly positioned on the underlayment 40. Both the underlayment 40 and the sheet 60 can be washed and sanitized, which satisfies AMA codes. Elastic corner straps 64 on the sheet 60 loop under the underlayment 40 corners to keep the bed sheet wrinkle free across the top surface 87 of the underlayment 40. The flocking 44 on the top surface 87 provides friction that helps keep it from wrinkling. A shield 50, described hereinbelow, further ensures a wrinkle free sheet surface at tail bone and hip pressure points by having approximately the same overall shape as the bottom of the cavity, and by being sized to jam-fit in the cavity 42. FIG. 3A uses an exploded cross-sectional view to illustrate this. The custom bed sheet 60 has a pocket 62 with a vertical sidewall 61 that extends for a depth of D to a flat pocket bottom 63 having lateral dimensions and shape substantially equivalent to the area A at the base 54 of the mattress cavity 42 which has a vertical sidewall 52 that extends for a depth of D from the top mattress surface 87 down to the base 54. The shield 50 is substantially flat except for two laterally opposed, upward extending side ridges 58, and has lateral dimensions and shape substantially equivalent to the area A.

Bedpan Assembly

FIGS. 4, 4A, and 4B show a flexible bedpan assembly 10 made up of a disposable flexible bedpan bag 20 with a drawstring 25 closure and a flexible support ring 30. The bedpan bag 20 is formed of a flexible watertight material, preferably either plastic sheet stock or, alternatively, a waterproof paper-like material (such as TYVEK® non-woven sheeting—a registered trademark of E. I. du Pont De Nemours & Co.).

The flexible bedpan bag 20 has a top opening 22 wide enough to have a cross-sectional area at least as big as the area A of the cavity 42. The bedpan bag 20 is shaped to include a bottom well 24 with volume indicators 26 for measuring a volume of waste discharged by the patient. At the opening 22, the material is formed into a sleeve 28 within which is a drawstring 25 which may be pulled to draw the opening 22 closed. The illustrated embodiment shows the drawstring 25 extending out of the sleeve 28 at one end of the bedpan bag 20, but another favored embodiment has the drawstring 25 extending out of two laterally opposed ends. If only one end, as shown, the drawstring 25 should extend from the bag 20 end opposite to that with the bottom well 24.

The flexible support ring 30 is made of semi-rigid plastic sheet stock, and is formed by bending a length of it into a hoop shape and fastening the ends together as at fastener 34. This fastening of the support ring 30 is intended to be permanent. In practice, for shipping and storage reasons, the fastening 34 may be something (e.g. a snap) that can be suitably engaged in the field, after shipping/storing the rings 30 as flat pieces. The flexible support ring 30 hoop is sized such that when forced into the cavity 42, it will take on the shape of the cavity and preferably will have about the same cross-sectional area A—thus close-fitting within the cavity.

The flexible support ring 30 surrounds and removably engages the opening 22 of the bedpan bag 20 to form a flexible bedpan assembly 10. A simple way of doing that is illustrated in FIG. 4, wherein the bag 20 is opened within the ring 30 and the sleeve 28 at the bag opening 22 is folded over the top of the ring 30 and back down around the outside of the ring 30 to form a cuff 38, which can be held more securely by tightening the drawstring 25. The support ring 30 thus holds the bedpan bag 20 open while it is installed in the cavity 42 of the underlayment 40 as shown in FIG. 4.

The support ring 30 in its simplest embodiment comprises a hoop formed of a substantially flat strip of a semi-rigid material. As shown in FIG. 6, the hoop can be laterally compressed to a narrow shape that may easily be moved in and out of the cavity 42 between the legs of a supine patient. The simplest embodiment of the bedpan assembly 10, therefore, is the simple hoop embodiment of the support ring 30 combined with a flexible bedpan bag 20 having a top opening 22 with a means for attachment on the support ring 30. In prior art the present inventor has disclosed using adhesive for the attachment means, but now introduces the drawstring 25 means. Another concept hereinnow disclosed is to permanently join the bag opening 22 to the ring 30, as with, for example, a ring in the sleeve 28, or a ring fused to the bag 20 material, or a ring-shaped portion of the bag 20 material being thickened into a semi-rigid form suitable for performing as the support ring 30.

In the most preferred embodiment, the support ring 30 provides a balancing ledge 32 on each opposing transverse side of the open support ring 30 to provide support for a support plug 70 (described hereinbelow) while the bedpan assembly 10 is not in use (also see FIG. 7).

Preferably extending from the lower edge of the support ring 30 are two fulcrum extensions 36, shown in FIGS. 4, 4B, 5 and 7, one on each lateral side of the support ring 30, that are fixedly attached to the support ring 30 or, in the preferred embodiment shown, are an integral part of the original flat strip from which the support ring 30 is formed. These fulcrum extensions 36 substantially engage a surface at the base of the cavity 42, thereby becoming a fulcrum for levering the support ring 30 from its inclined insertion position to a stable substantially horizontal installed position. These extensions 36 allow the support ring 30 and the associated bedpan bag 20 to be inserted into the cavity 42 at an angle as at A and B and then to tip to a substantially horizontal installed position, being supported there by the fulcrum extensions 36. Once the support ring 30 carrying the bedpan bag 20 is installed, the fulcrum extensions 36 act as vertical supports to maintain the support ring 30 at a proper height (e.g., 2 or 3 inches below the top 87 of the underlayment, thereby leaving room for the caregiver to work).

The installing of the support ring 30 is illustrated in the perspective view of FIG. 5, wherein the phantom outlines indicate the support ring 30 at various stages 30A, 30B, 30C during the installing process, while FIG. 6 shows in top view the corresponding stages 30A', 30B', 30C' of the lateral compression of the support ring 30. At 30A and 30A', the support ring 30 is laterally compressed to fit between the legs of the patient, and only the leading edge of the ring 30 has entered the cavity 42. At 30B and 30B', the leading edge of the ring 30 has touched the far wall of the cavity 42 so that further pressure to insert the support ring 30 causes it to expand to an open position. After the ring 30 is expanded to substantially touch the entire wall of the cavity 42, when the fulcrum extension 36 is in contact with the bottom of the cavity 42 (or preferably the shield 50) and the trailing edge of the ring 30 has entered the cavity, then the trailing edge may be pressed downward to tilt the ring 30 to a horizontal, fully installed position 30C, shown in solid lines.

At the open end 22 of the bedpan assembly 10, the drawstring 25 is used to tighten the bedpan bag 20, and also to pull the bedpan bag 20, selectively with or without the support ring 30, from between the patient's legs for removal of the bedpan bag 20 and disposal of the waste. A caregiver grasps and pulls the drawstring 25 upward and out of the cavity 42.

In one scenario, continued pulling of the drawstring 25 encourages the support ring 30 to compress it the transverse direction, thereby to permit easy withdrawal of the support ring 30, the attached flexible bedpan bag 20, and the waste collected therein.

In a second scenario, continued pulling of the drawstring 25 undoes the cuff 38 and pulls the bag opening 22 up off the support ring 30, then draws the bag 20 closed so that the closed bag 20 can be pulled out without concern about spilling the waste in it. After removing the bedpan bag 20 from the cavity 42, the caregiver can hold it by the drawstring 25, thereby allowing the collected waste material to fall into the well 24 that has volume indicator marks 26 as illustrated in FIG. 4 and FIG. 4A thereby permitting observation of the quantity of excrement/waste and recording the quantity in the patient's record. Samples of the excrement may be taken for testing, if desired, then the flexible bedpan bag 20 may be dumped and disposed, allowing a new flexible bedpan bag 20 to be fitted to the support ring 30 for reuse thereof as often as desired.

In a third scenario utilizing the two-ended drawstring embodiment, before removal, the rear drawstring 25 (i.e. farthest from the caregiver, toward the head 90 of the bed) can be pulled closed while under the patient, and the bedpan assembly 10 is pulled out by the rear string 25 and the front drawstring 25 or corresponding part of support ring 30, while the front end (towards caregiver at foot 91 of bed) of the bag 20 remains open, so when the bag 20 is removed from the support ring 30 the bag's contents can be poured out into a toilet; then the front drawstring is used to draw the bag 20 completely closed for sanitary disposal.

In a fourth scenario, as the patient lays in a supine position or a seated position, on a mattress 40 with a cavity 42 under the buttocks, the caregiver folds the bag 20 of the bedpan assembly 10 over to the side and presses both sides of the assembly's opening 22 together so all that is needed is one inch of space in between the patient's inner thighs. Now the caregiver slides the bedpan assembly 10 down into the cavity 42. As the assembly 10 reaches the base 54 (or shield 50) and inner sidewall 52 of the cavity 42, it will pop open into place as shown in FIG. 4.

To remove the bedpan assembly 10 the caregiver grasps the drawstring 25 and slowly pulls the bedpan assembly 10 out from under the patient, through their inner thighs at an upward angle, while laterally pressing together the sides of the support ring 30 as if to close the bag opening 22. In doing this, the contaminated waste runs down into the extended elongated end 24 of the bedpan's bag-like body 20. Then the entire disposable bedpan is disposed of Now the caregiver can clean off the patient and replace a new bedpan assembly into the cavity 42.

Shield

Referring particularly to FIGS. 7-9C, in a preferred mode of this invention, the bottom 54 of the cavity 42 is lined with a shield 50 of fairly rigid material (e.g., plastic) to serve as a base for the fulcrum extensions 36, thereby to eliminate wear on the cavity bottom/floor/base 54, and the sheet pocket 62 at the bottom at the cavity 42. When used with custom fitted sheets 60 the shield rests on top of the sheet's pocket 62 at the base of the cavity 42 (see FIGS. 3-3A) and under the support ring 30 fulcrum extensions. The plastic shield 50 is wedge-shaped sized and shaped the same as the cavity shape, which is wedge-shaped in a preferred embodiment, with a finger grip opening 56 at the wide end (toward the foot 91 of the underlayment 40) for finger gripping for easy removal of the shield 50. The shield 50 is pressed down (jam-fit) into the cavity 42 to create a floor that wedges the bed sheet between the edges of the shield 50 and the walls 52 of the cavity 42, thereby eliminating wrinkles from the bed sheet around the cavity opening to protect vital areas under the patient from irritation.

As shown in FIGS. 9A-9C, short (e.g., half inch) side ridges 58 extend upward on each side of the shield 50, and are used to contain the fulcrum extensions 36 of the bedpan support ring 20. This is a safety measure. If the underlayment 40 deflates while the bedpan assembly 10, or at least the support ring 20, is in the cavity 42, then downward pressure from the descending patient will be translated by the side ridges 58 into laterally inward force such that the fulcrum extensions 36 will bend and slide inward to become substantially flat instead of remaining as an upright obstacle under the patient's buttocks.

Support Plug

The optional support plug 70 is preferably a foam cushion, has a thickness/height P of about two to three inches, or about half the depth D of the cavity 42, and preferably has a rigid (e.g.

plastic) bottom surface 68. The plug thickness P is selected to position the plug's top surface properly when the plug 70 rests on the support ring's balancing ledges 32. As shown in FIG. 7 and FIG. 8, the support plug 70 is placed atop the bedpan support ring 30 when it is installed in the cavity but not in use, thereby filling the open space of the cavity 42 above the support ring 30, thereby producing a substantially flat top surface that is coextensive with the top surface 87 of the underlayment 40.

The support plug 70 is adapted for easy removal when the flexible bedpan bag 20 is required. In FIG. 8, a side view shows that the support plug 70 is encased in a pillow case 72 that has an extended tail 74 which is used to pull out the support plug 70. Preferably the plug 70 has a vertical wedge shape such as is shown in FIG. 8 wherein at least one end 66 (head or foot) is tapered to a lesser thickness P' than the rest of the plug 70. This tapered end 66 eases pulling the plug 70 out of the cavity 42 and/or can ease pushing it in under the legs of a patient. Preferably the tapered end 66 is at the head 90 of the bed. An optional hard smooth plastic bottom surface 68 will help keep the shape of the plug 70, helps secure it atop the balancing ledges 32, and may also help in sliding the plug 70 in and out of the cavity. The plug 70 has a soft flocked top surface 44, like the underlayment 40. The flocking prevents perspiration and sliding, but the support plug 70 can still be washed and sanitized, satisfying the AMA's safety and sanitation codes.

Patients who have lost control of elimination (e.g., incontinent) will not use the plug 70, leaving the cavity 42 open with a bedpan bag 20 therein to catch waste elimination as it occurs. This arrangement allows patients to air out and if necessary, heal their privates, since they can freely relieve themselves at any time without use of diapers and their attendant problems.

The above-disclosed invention has several particular features that are best practiced in concert, although each is useful individually, without departure from the scope of the invention. We have merely described preferred embodiments of the invention and it will be understood that the invention may be embodied otherwise than as herein illustrated and described. The scope of the invention should be determined by the appended claims and their legal equivalents, rather than only by the examples given.

Although the invention has been illustrated and described in detail in the drawings and foregoing description, the same is to be considered as illustrative and not restrictive in character—it being understood that only preferred embodiments have been shown and described, and that all changes and modifications that come within the spirit of the invention are desired to be protected. Undoubtedly, many other "variations" on the "themes" set forth hereinabove will occur to one having ordinary skill in the art to which the present invention most nearly pertains, and such variations are intended to be within the scope of the invention, as disclosed herein.

What is claimed is:

1. A bedpan system including an underlayment for supporting a supine human patient above a substantially horizontal supporting surface, wherein the underlayment has: a substantially horizontal top surface upon which the patient rests, a substantially parallel, spaced apart bottom surface for lying upon the supporting surface, and a bedpan cavity having an open top in registry with buttocks of the patient; the bedpan system comprising:

an underlayment comprising:

an inflatable mattress constructed substantially of flexible plastic sheet material comprising: a top sheet providing the top surface, a bottom sheet providing the bottom surface, side wall sheets attached between the top sheet and the bottom sheet providing substantially vertical side walls around the perimeter of the underlayment when it is inflated, and cavity sidewall sheets attached between the top sheet and the bottom sheet providing a cavity top seam and a cavity bottom seam, respectively, and substantially vertical sidewalls in the cavity; and a smooth junction at the cavity top seam where the cavity sidewalls join with the top surface, thereby precluding irritation of a patient's sensitive skin;

and the bedpan system further comprising:

a fitted bed sheet tailored to cover the top surface of the underlayment with a top surface portion, plus an integral pocket tailored to closely fit as a lining inside the entire cavity, the pocket having an open top at the cavity top seam, and a closed bottom at the cavity bottom seam;

a seam where the pocket joins the top surface portion of the bed sheet wherein the seam is substantially smooth wherever it is exposed at, or on top of the underlayment top surface; and a rigid shield, having approximately the same overall shape as the cavity and sized to jam-fit in the cavity while pressing down on the pocket bottom, thereby to hold the top surface portion of the bed sheet tight and wrinkle-free around the cavity.

2. The bedpan system of claim 1, further comprising:

a disposable bedpan assembly that comprises:

a flexible support ring having about the same cross-sectional area as the cavity, suitable for horizontally close-fitting within the cavity; and a flexible bedpan bag on the support ring, with a top opening wide enough to have a cross-sectional area at least as big as the cross-sectional area of the cavity.

3. The bedpan system of claim 2, further comprising:

a drawstring within a sleeve formed by the bedpan bag material around the top opening.

4. The bedpan system of claim 1, further comprising:

a flocked top surface of the underlayment.

5. The bedpan system of claim 1, further comprising:

a flocked bottom surface of the underlayment.

6. The bedpan system of claim 1, further comprising:

a tufted bladder construction for the underlayment air mattress wherein the top sheet and bottom sheet are joined at intervals over their areas, which joinings are made by means of intermediary strips attached at each respective end thereof to the top sheet and bottom sheet, the strips being formed into vertical cylinders that are enclosed except for perforation holes or slits that are shaped and sized to limit the rate of air passage out of the cylinders to a relatively slow deflation rate.

7. The bedpan system of claim 1, further comprising:

a two-way inflation control valve for control of underlayment rigidity, the control valve comprising:

a one-way check valve for inflation; and a manually operable controlled bleed valve.

8. The bedpan system of claim 1, further comprising:

an underlayment that is thick enough to accommodate a cavity depth of at least 2 inches more than the height of a bedpan assembly being used in the cavity, thereby providing adequate patient cleaning space.

9. The bedpan system of claim 1, further comprising:

a plug for filling the cavity space between a bedpan in the cavity and the underlayment top surface, the plug comprising:

a flocked top surface and a smooth rigid bottom surface; and a vertical taper ramping a portion of the plug's bottom surface upward to a thinned edge.

10. The bedpan system of claim 9, further comprising:

a pillowcase for encasing the plug, wherein the pillowcase is:

tailored to be close fitting around the front and side edges of the plug; and open at the back edge of the plug, such that it has a tail for grasping and pulling the plug out of the cavity and toward the foot of the underlayment.

11. The bedpan system of claim 1, further comprising:

elastic bands at bed sheet corners for holding the bed sheet tight on the underlayment.

12. The bedpan system of claim 1, further comprising:

a cavity base that is joined to the cavity sidewalls as a closed bottom for the cavity, effectively making the bottom surface of the underlayment a single, unitary, or continuous sheet including under the cavity; thereby increasing localized support of a patient's buttocks when the underlayment is bent upwards.

* * * * *